US011731018B1

(12) United States Patent
Burns, III

(10) Patent No.: US 11,731,018 B1
(45) Date of Patent: Aug. 22, 2023

(54) FLEXIBLE NET SYSTEM

(71) Applicant: EastPoint Sports Ltd., LLC, Succasunna, NJ (US)

(72) Inventor: James P. Burns, III, Cranford, NJ (US)

(73) Assignee: EastPoint Sports Ltd., LLC, Succasunna, NJ (US)

( * ) Notice: Subject to any disclaimer, the term of this patent is extended or adjusted under 35 U.S.C. 154(b) by 0 days.

(21) Appl. No.: 18/165,612

(22) Filed: Feb. 7, 2023

Related U.S. Application Data

(60) Provisional application No. 63/267,669, filed on Feb. 8, 2022.

(51) Int. Cl.
*A63B 61/04* (2006.01)
*A63B 61/00* (2006.01)
*A63B 61/02* (2006.01)

(52) U.S. Cl.
CPC ..... *A63B 61/003* (2013.01); *A63B 61/02* (2013.01)

(58) Field of Classification Search
CPC ..... A63B 61/003; A63B 61/02; A63B 61/04
See application file for complete search history.

(56) References Cited

U.S. PATENT DOCUMENTS

| | | | |
|---|---|---|---|
| 254,018 | A | 2/1882 | Johnson |
| 411,387 | A | 9/1889 | Manning |
| 425,568 | A | 4/1890 | Edelkamp |
| 666,464 | A | 1/1901 | Buckley |
| 714,411 | A | 11/1902 | Steinmetz |
| 724,686 | A | 4/1903 | Fleeger |
| 748,407 | A | 12/1903 | McIntire |
| 809,083 | A | 1/1906 | Ackerman |
| 1,556,046 | A | 10/1925 | Muir |
| 2,004,579 | A | 6/1935 | Lichtenstein |

(Continued)

FOREIGN PATENT DOCUMENTS

| | | | | |
|---|---|---|---|---|
| CN | 111957019 | A * | 11/2020 | ..... A63B 61/02 |
| CN | 113350755 | A * | 9/2021 | |

(Continued)

OTHER PUBLICATIONS

Dick's Sporting Goods advertisement dated Dec. 10, 2018.

(Continued)

*Primary Examiner* — Raleigh W Chiu
(74) *Attorney, Agent, or Firm* — James A. Joyce; Godfrey & Kahn, S.C.

(57) ABSTRACT

A flexible net system is provided that includes a net having a net first end and a net second end, a net top portion, and a net bottom portion. The system further including a pair of support bases including a first support base and a second support base, each support base including a base bottom portion, a support portion extending upwards from the base bottom portion, the support portion engaging and pivotably securing a control arm thereto, and a base strap having a base strap first end secured to the support portion and a base strap second end secured to the net bottom portion. The system further including a first net support pole and a second net support pole, wherein the first net support pole and the second net support pole are resiliently bendable and coupled between the net and respective support bases, and a plurality primary support ropes.

20 Claims, 11 Drawing Sheets

(56) References Cited

U.S. PATENT DOCUMENTS

| | | | |
|---|---|---|---|
| 2,280,376 | A | 4/1942 | Clark |
| 3,819,182 | A | 6/1974 | Lersch |
| 3,891,210 | A | 6/1975 | Van Horne |
| 4,022,471 | A | 5/1977 | Keller |
| 4,037,838 | A | 7/1977 | Mccune |
| 4,147,347 | A | 4/1979 | Angove |
| 4,176,842 | A | 12/1979 | Zaldivar |
| D254,018 | S | 1/1980 | Malm et al. |
| 4,284,277 | A | 8/1981 | Leonard et al. |
| 4,372,561 | A | 2/1983 | Morgan et al. |
| 4,433,838 | A | 2/1984 | Gordon |
| 4,576,364 | A | 3/1986 | O'Fearna |
| 4,650,189 | A | 3/1987 | Rajacich |
| 4,715,598 | A | 12/1987 | Knight |
| 4,720,112 | A | 1/1988 | Stettner |
| 4,772,018 | A | 9/1988 | Inniger |
| 4,775,152 | A | 10/1988 | Roehl |
| 4,948,149 | A | 8/1990 | Lin |
| 4,962,935 | A | 10/1990 | Williams |
| 5,014,983 | A | 5/1991 | Saunders |
| D329,063 | S | 8/1992 | Kantor |
| 5,217,230 | A | 6/1993 | Judd |
| 5,290,043 | A | 3/1994 | Blagoje |
| 5,303,932 | A | 4/1994 | Kessler |
| 5,472,212 | A | 12/1995 | Bercaw |
| 5,549,304 | A | 8/1996 | Davis |
| 5,575,471 | A | 11/1996 | Robinson |
| 5,655,979 | A | 8/1997 | Blue |
| 5,730,442 | A | 3/1998 | Anderson |
| 5,989,130 | A | 11/1999 | Macaluso |
| 6,485,373 | B1 | 11/2002 | Stephens |
| 6,802,789 | B1 | 10/2004 | Ishino |
| 6,807,999 | B1 | 10/2004 | Bowen et al. |
| 6,966,852 | B2 | 11/2005 | Yoon |
| 7,137,911 | B2 | 11/2006 | Giegerich |
| 7,229,128 | B2 | 6/2007 | Lee |
| 7,367,907 | B1 | 5/2008 | Sutton et al. |
| D585,949 | S | 2/2009 | Gaudin et al. |
| 7,485,053 | B2 | 2/2009 | Nally |
| 7,608,000 | B2 | 10/2009 | Butler |
| 7,727,091 | B2 | 6/2010 | Allen |
| 7,841,958 | B2 | 11/2010 | Fleming et al. |
| 8,062,153 | B2 | 11/2011 | Boseman |
| 8,074,669 | B2 | 12/2011 | Collins et al. |
| 8,100,784 | B2 | 1/2012 | Conforti |
| 8,122,536 | B2 | 2/2012 | Peixin et al. |
| 8,245,332 | B2 | 8/2012 | Yul et al. |
| 9,504,892 | B2 | 11/2016 | Saphire |
| 2002/0005512 | A1 | 1/2002 | Trill |
| 2004/0005941 | A1 | 1/2004 | Chen |
| 2004/0132558 | A1 | 7/2004 | Rothman |
| 2004/0214666 | A1 | 10/2004 | Dilling |
| 2007/0087869 | A1 | 4/2007 | Lin |
| 2007/0228349 | A1 | 10/2007 | Smith |
| 2008/0067751 | A1 | 3/2008 | Hunt |
| 2009/0260666 | A1 | 10/2009 | Zheng |
| 2010/0175731 | A1 | 7/2010 | Day |
| 2014/0243119 | A1* | 8/2014 | Whalen ..... A63B 61/02 473/493 |

FOREIGN PATENT DOCUMENTS

| | | | | |
|---|---|---|---|---|
| DE | 2321436 | | 11/1974 | |
| DE | 2846142 | | 4/1980 | |
| DE | 19916622 | | 10/1999 | |
| EP | 0242009 | | 10/1987 | |
| EP | 0329585 | | 8/1989 | |
| EP | 1614452 | | 1/2006 | |
| EP | 2366438 | A1 * | 9/2011 | ..... A63B 61/02 |
| FR | 1350554 | | 1/1964 | |
| FR | 2694704 | | 2/1994 | |
| FR | 2794658 | | 12/2000 | |
| FR | 2815261 | | 4/2002 | |
| FR | 2954170 | | 6/2011 | |
| FR | 3031043 | A1 * | 7/2016 | ..... A63B 61/003 |
| FR | 3077500 | A1 * | 8/2019 | ..... A63B 61/00 |
| GB | 400850 | | 11/1933 | |
| GB | 978069 | | 12/1964 | |
| GB | 2448989 | | 11/2011 | |
| JP | 2000140178 | | 5/2000 | |
| KR | 200282197 | | 7/2002 | |
| KR | 200482421 | Y1 * | 2/2017 | ..... A63B 61/003 |

OTHER PUBLICATIONS

Dick's Sporting Goods advertisement dated Dec. 17, 2018.
Dick's Sporting Goods advertisement dated Dec. 3, 2018.
Photograph of Pingpong the Original 3 in 1 pop-up table tennis set.
Preliminary Report for French Patent Publication No. 2694704 dated May 10, 1993.
Preliminary Report for French Patent Publication No. 2815261 dated Aug. 30, 2001.

* cited by examiner

FLEXIBLE NET SYSTEM

CROSS-REFERENCE TO RELATED APPLICATIONS

This application claims the benefit of and priority to U.S. Provisional Patent Application Ser. No. 63/267,669 filed on Feb. 8, 2022, the contents of which are incorporated herein by reference in their entirety.

FIELD OF THE INVENTION

The described embodiments relate generally to the field of sports and games. More particularly, the described embodiments relate to net assemblies for sports and games.

BACKGROUND OF THE INVENTION

The setting up of a net for sports and games, such as, for example badminton, volleyball, tennis, pickleball, etc., can be difficult, complicated, time consuming. Such issues can discourage participants from purchasing and/or using existing net systems and playing associated games.

BRIEF SUMMARY

In at least some embodiments, disclosed is a flexible net system that includes: a net having a net first end and a net second end, with a net top portion and a net bottom portion extending between the net first end and the net second end; a pair of support bases including a first support base and a second support base, each support base including: a base bottom portion having a bottom surface for contact with a ground surface; a support portion extending upwards from the base bottom portion, the support portion engaging and pivotably securing a control arm thereto, wherein the control arm is pivotable to a substantially vertical position; and a base strap having a base strap first end secured to the support portion and a base strap second end secured to the net bottom portion; a first net support pole and a second net support pole, wherein the first net support pole and the second net support pole are resiliently bendable and coupled between the net and respective support bases; and a plurality primary support ropes coupled to the net and configured to be secured adjacent the ground surface with respective ground stakes.

In at least some other embodiments, disclosed is a flexible net system that includes: a net having a net first end and a net second end, with a net top portion and a net bottom portion extending between the net first end and the net second end; a pair of support bases including a first support base and a second support base, each support base including: a base bottom portion having a bottom surface for contact with a ground surface; a support portion extending upwards from the base bottom portion, the support portion including an arm channel for at least partially receiving and pivotably securing a control arm; a plurality of springs coupled to the control arm and the support portion, wherein the plurality of springs provides a downward bias to the control arm; and an adjustable base strap having a base strap first end secured to the support portion and a base strap second end secured to the net bottom portion; and a first net support pole and a second net support pole, wherein the first net support pole and the second net support pole are resiliently bendable and coupled between the net and respective support bases, wherein the first net support pole is coupled to the control arm of the first support base, and the second net support pole is coupled to the control arm of the second support base.

Other embodiments, aspects, features, objectives and advantages of the present invention will be understood and appreciated upon a full reading of the detailed description and the claims that follow.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals may be used to indicate like components. In the drawings.

DETAILED DESCRIPTION

Figure 1:
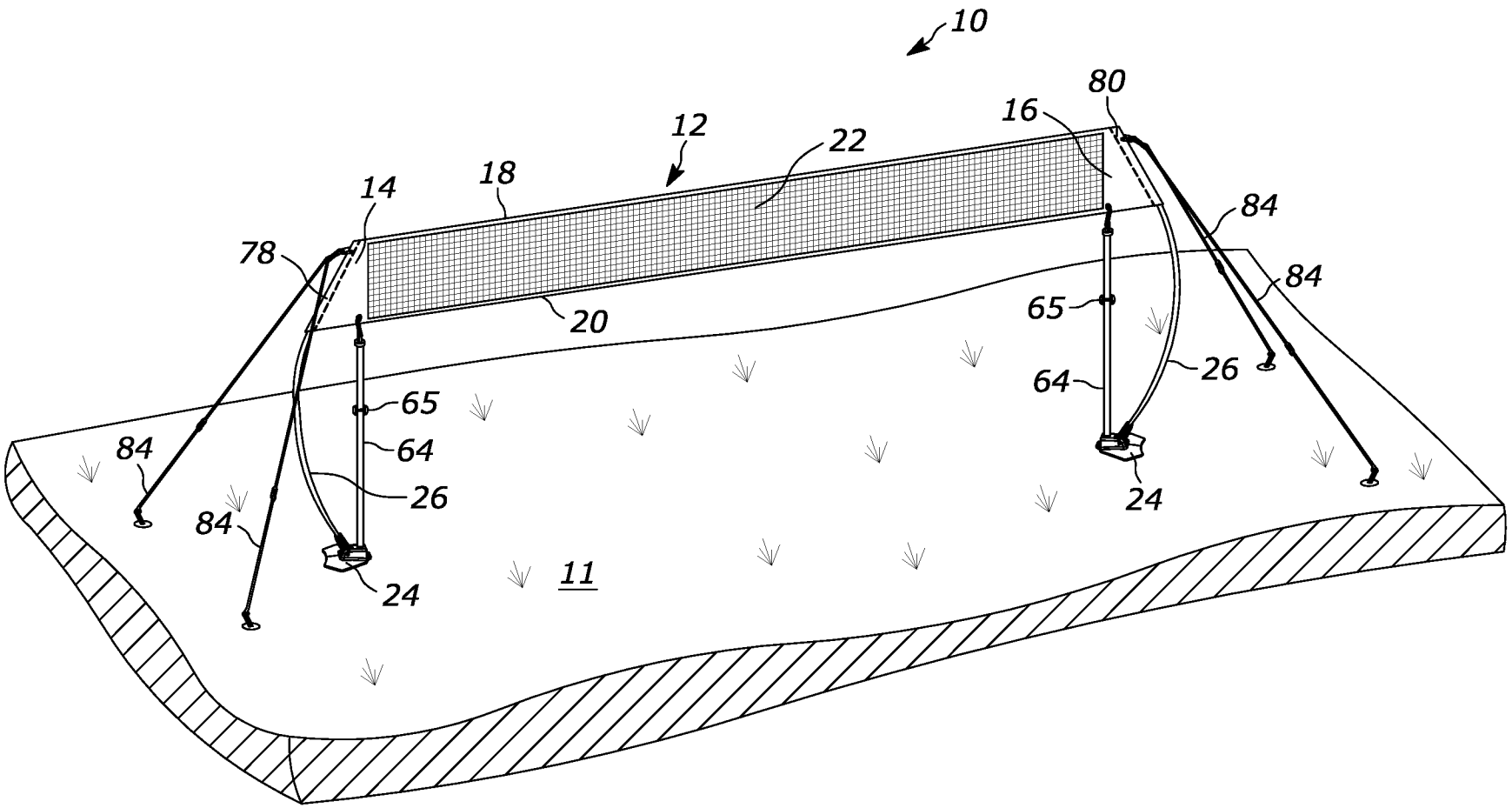
FIG. 1 is a perspective view of an exemplary embodiment of a flexible net system in a fully assembled position on a ground surface.
Figure 2:
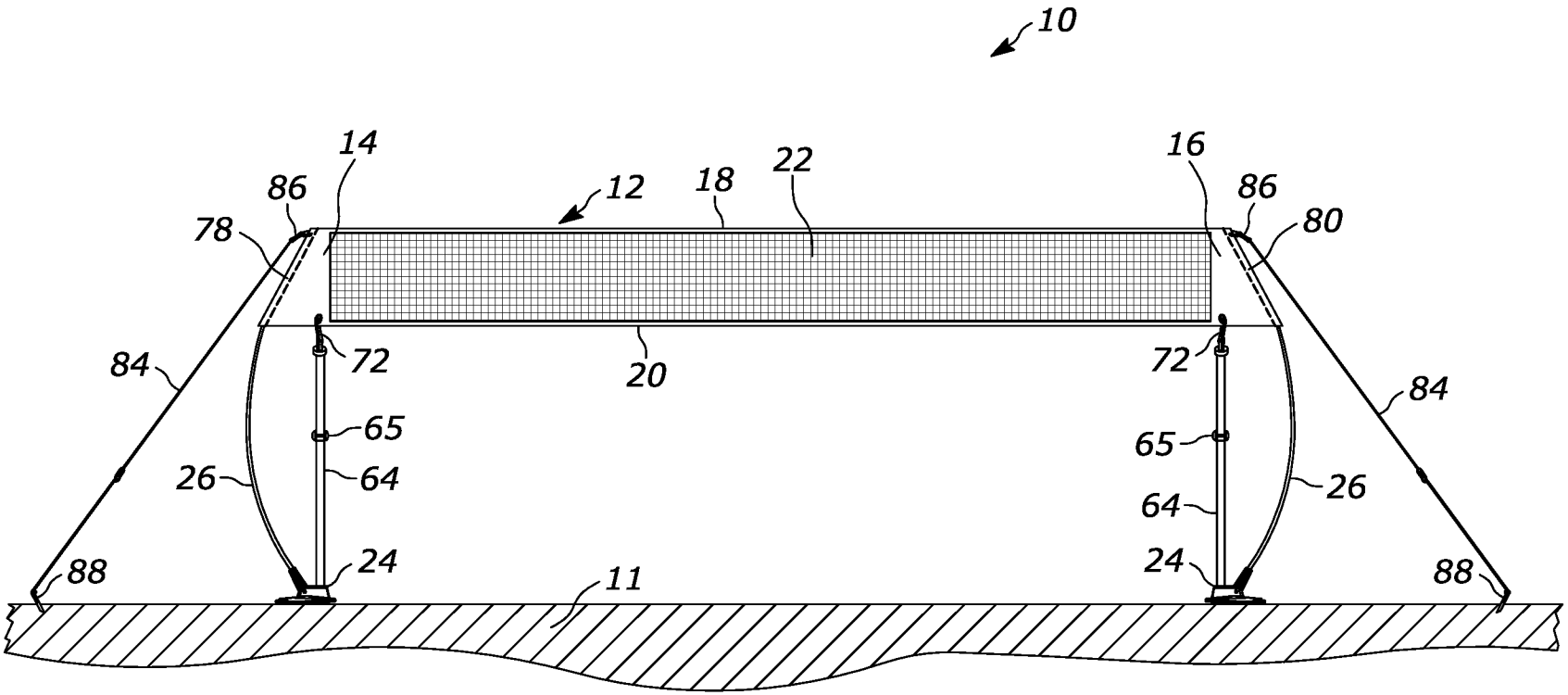
FIG. 2 is a front elevation view of the flexible net system of FIG. 1 in the fully assembled position on the ground surface.
Figure 3:
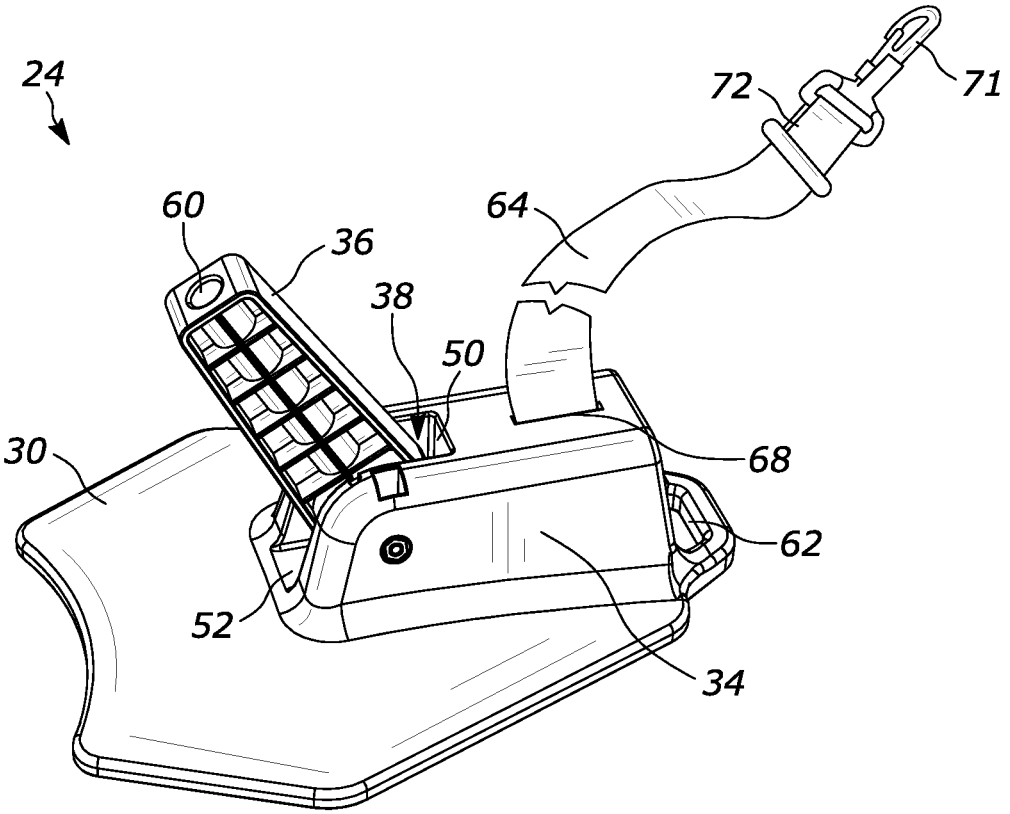
FIG. 3 is a top perspective view of the support base of FIG. 1.
Figure 4:
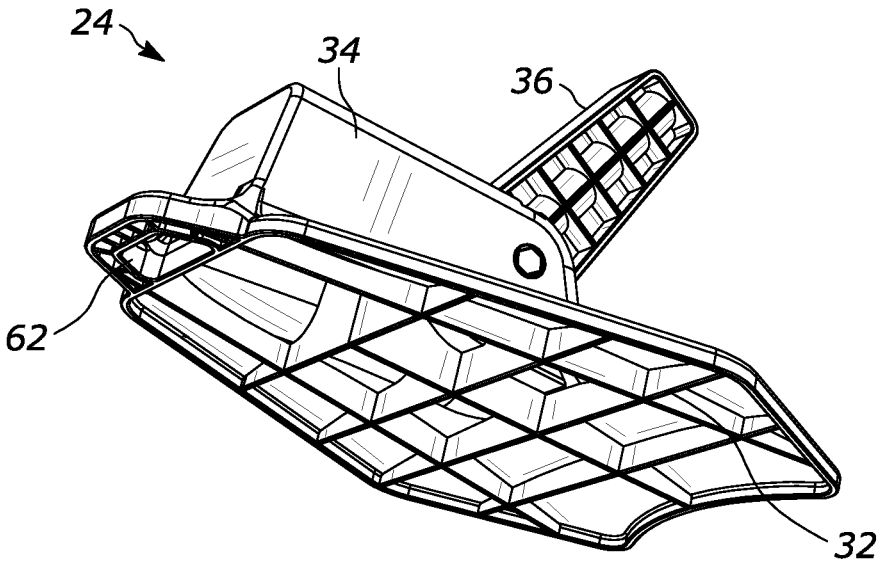
FIG. 4 is a bottom perspective view of the support base of FIG. 3.
Figure 5:
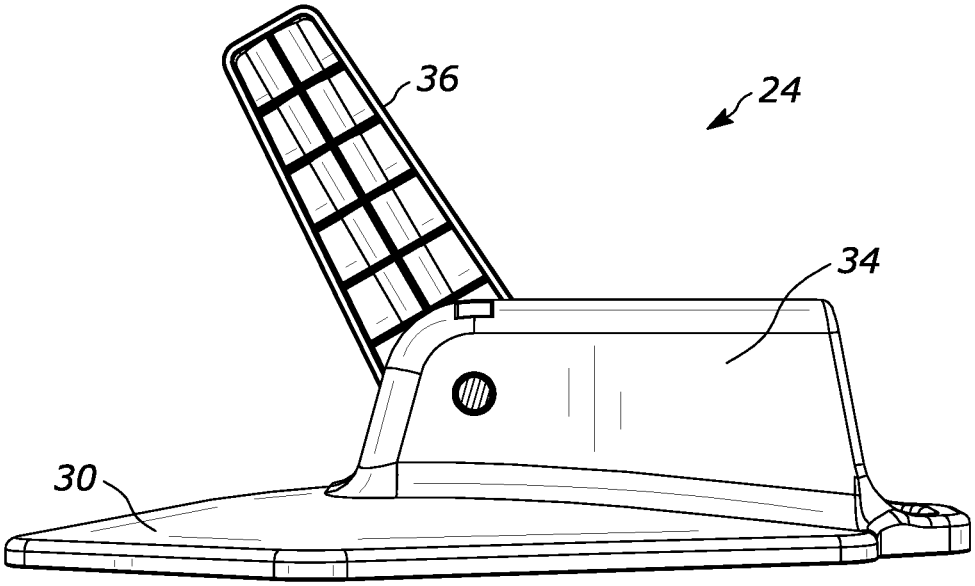
FIG. 5 is a front view of the support base of FIG. 3.
Figure 6:
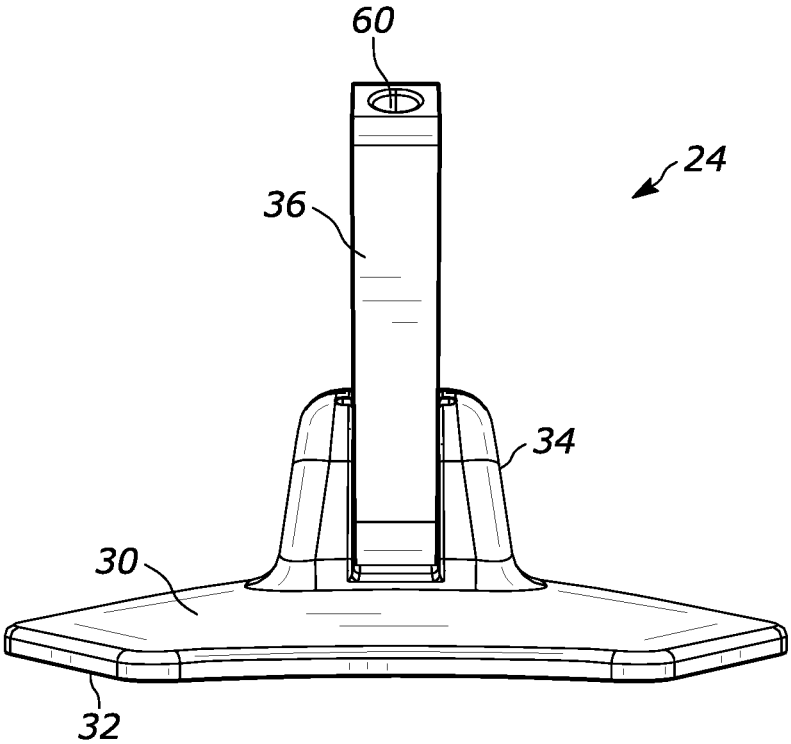
FIG. 6 is a side view of the support base of FIG. 3.
Figure 7:
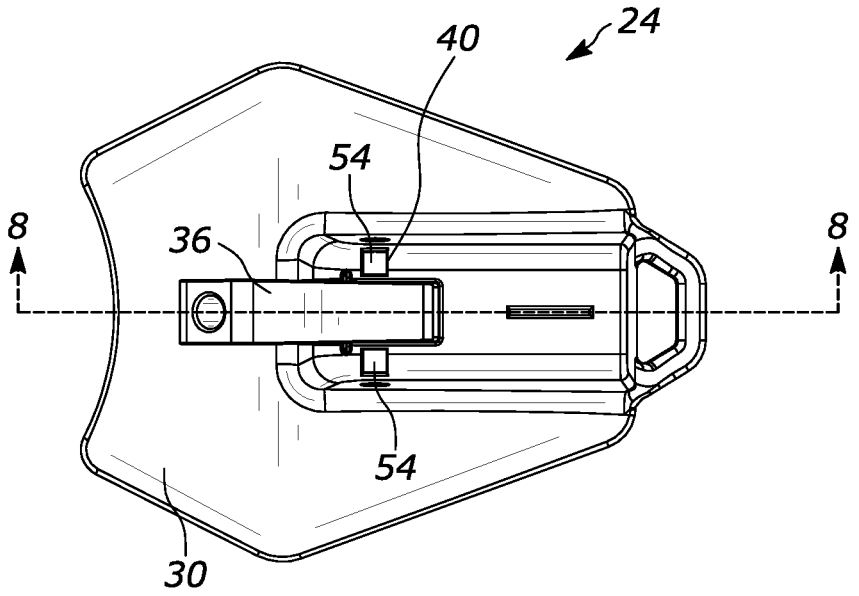
FIG. 7 is a top view of the support base of FIG. 3.
Figure 8:
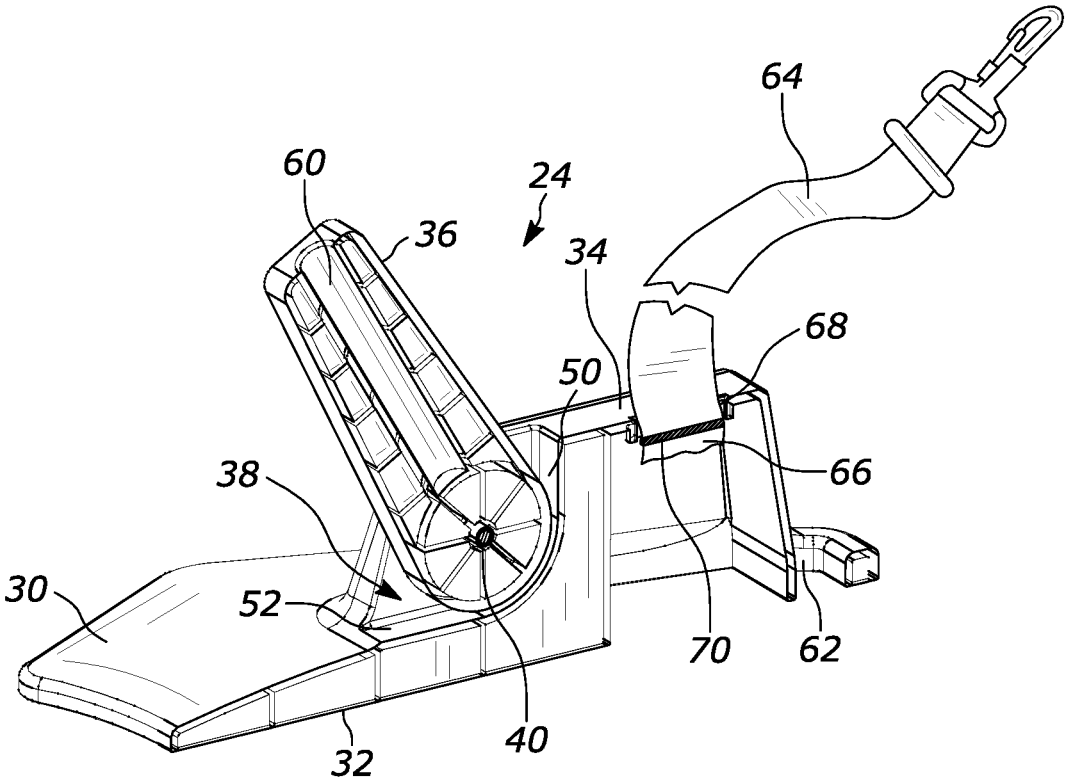
FIG. 8 is a perspective cross-sectional view of the support base taken along lines 8-8 of FIG. 7.
Figure 9:
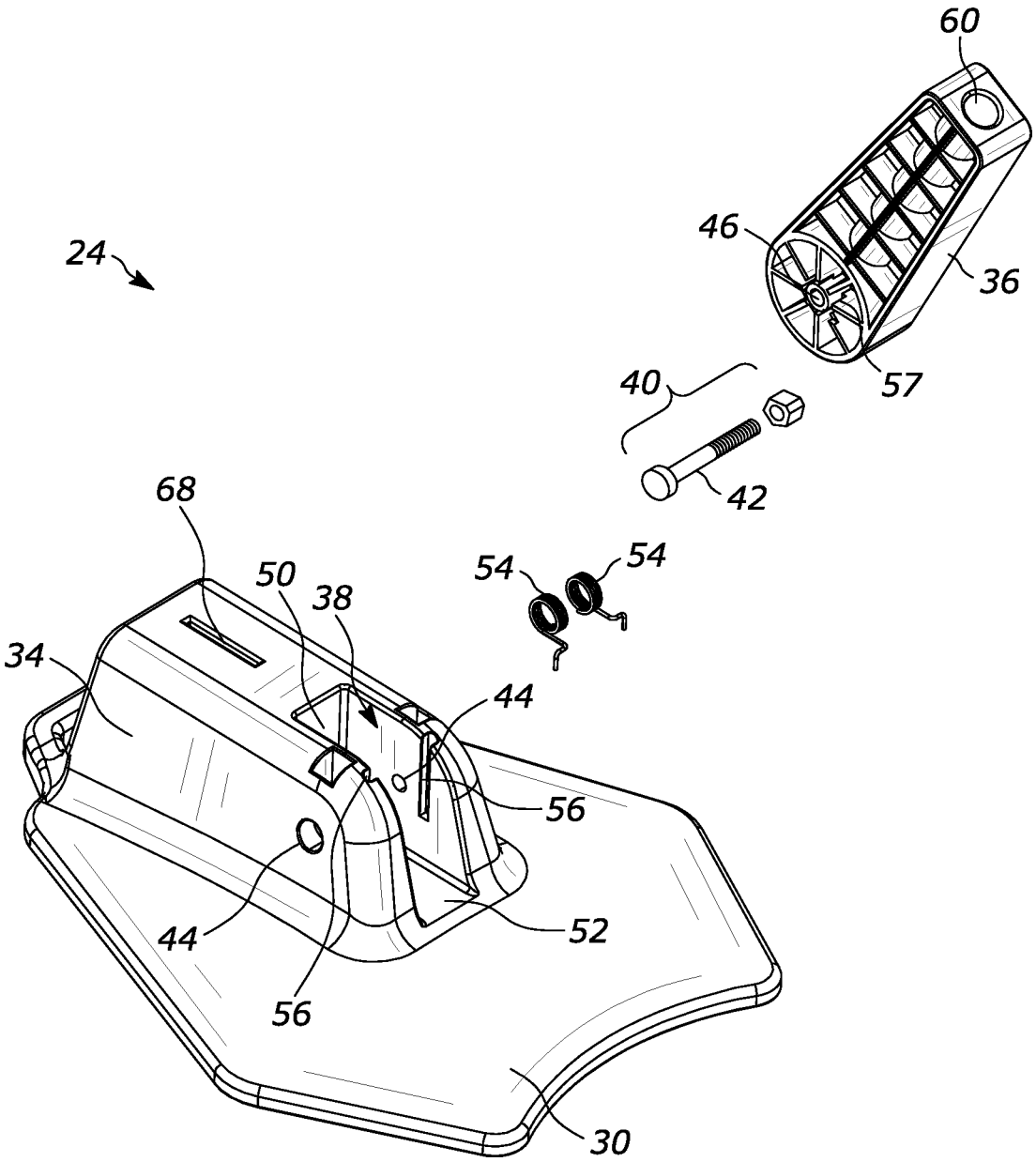
FIG. 9 is an exploded perspective view of the support base of FIG. 3.

Referring to FIGS. 1-2, perspective and front views of an exemplary embodiment of a flexible net system 10 secured to a ground surface 11 are provided. The flexible net system 10 includes a net 12 having a net first end 14 and a net second end 16, with a net top portion 18 and net bottom portion 20 both extending longitudinally between the net first end 14 and the net second end 16. The net 12 is generally sized for use in sports, such as volleyball and badminton, having a mesh center portion 22 with a width and length suitable for such sports, although the net dimensions can vary to suit different applications.

The net 12 is vertically supported on opposite sides using a pair of support bases 24 and resiliently bendable net support poles 26. In at least some embodiments, as seen in FIGS. 3-9, the support base 24 includes a base bottom portion 30 having a bottom surface 32 for contact with the ground surface 11, where the bottom surface 32 can be substantially planar. The support base 24 also includes a support portion 34 extending upwards from the base bottom portion 30, with the support portion 34 engaging and pivotably securing a control arm 36 thereto, wherein in at least some embodiments, the control arm 36 is pivotable to a substantially vertical position and/or a substantially horizontal position.

The control arm 36 can be pivotably secured to the support portion 34 using various methods. For example, in at least some embodiments, the support portion 34 can include an arm channel 38 for at least partially receiving the control arm 36 therein. A control arm fastener 40, such as a pin, bolt and nut, rivet, etc. having a shaft portion 42, can be extended through apertures 44 in the support portion 34 on opposite sides of the arm channel 38 and through a transverse cylindrical pivot passage 46 in the control arm 36. The arm channel 38 can extend between a vertical stop wall 50 and a horizontal stop wall 52 formed in the support portion 34. This allows the control arm 36 to pivot between a horizontal position and a vertical position, but prevents over-pivoting of the control arm 36 beyond the vertical position. In at least some embodiments, one or more springs can be coupled with the control arm 36 and support portion 34 to provide a downward spring bias on the control arm 36, although such spring are not required in all embodiments. Various types of springs and coupling configurations can be utilized to provide a spring bias. For example, torsion springs 54 can be centered over the shaft portion 42 on opposite sides of the control arm 36, with first ends coupled to the control arm 36 and second ends secured to the support portion 34 (such as slid into spring grooves 56) (see FIGS. 7 and 9). In at least some embodiments, the control arm 36 can include a circumference of notches 57 along the outside of the pivot passage 46 on either side of the control arm 36 to allow the springs 54 to recess at least partially within and engage the control arm 36.

In at least some embodiments, the control arm 36 can be rounded at a first end and taper as it extends away from the pivot passage 46. The control arm 36 is configured to engage with the net support pole 26. In at least some embodiments, the control arm 36 includes a net support pole passage 60 sized and shaped for receiving a length of the net support pole 26 therein. The net support pole passage 60 can extend longitudinally through the control arm 36 in a direction perpendicular to the pivot passage 46.

To assist with securing the support base 24 to the ground surface 11, a staking aperture 62 can be provided in the base bottom portion 30 for receiving/engaging a respective ground stake (not shown). The support base 24 further includes a base strap 64 having a base strap first end 66 secured thereto, wherein in at least some embodiments, the base strap first end 66 extends through a strap slot 68 in the support portion 34 and is anchored with an enlarged end configuration, such as a bar 70 (or buckle, knot, etc.) (see FIG. 8) to prevent the base strap first end 66 from passing out of the support portion through the strap slot 68. The base strap 64 further includes a base strap second end 72 that is secured to the net bottom portion 20. In at least some embodiments, the base strap is adjustable in length and can include a latch 71 (see FIG. 3) secured at the base strap second end 72 for releasably coupling to the net bottom portion 20. In other embodiments, the base strap 64 can be secured to the net 12 using various other methods. For illustration purposes only, the base strap 64 is not depicted in FIGS. 4-7, and 9.

Figure 10:
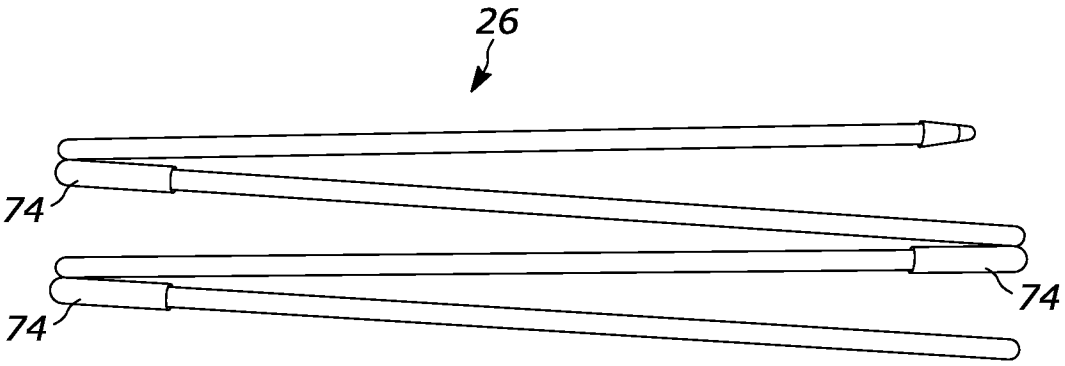
FIG. 10 is a perspective view of the net support pole of FIG. 1, shown in a disassembled condition.
Figure 11:
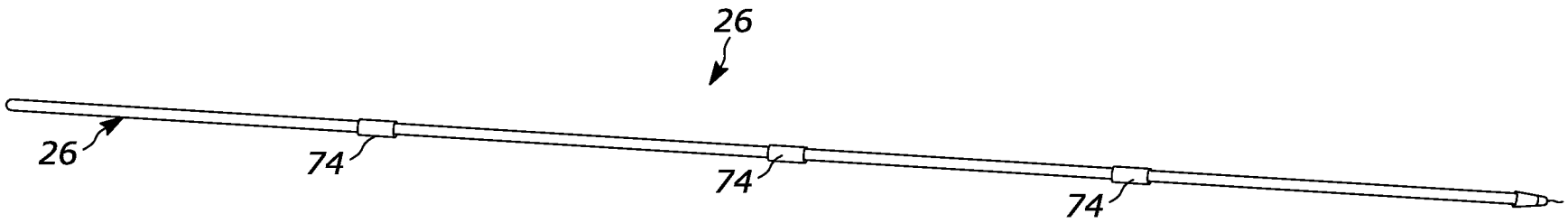
FIG. 11 is a perspective view of the net support pole of FIG. 10, shown in an assembled condition.

The net support poles 26 can take many forms, although in at least some embodiments, they are comprised of one or more resiliently bendable fiberglass rods. To assist with easy storage, in some embodiments the net support poles 26 can be multi-sectioned (similar to tent poles for example) including several sections with longitudinal couplers 74 (male-to-female screw or ferrule connections, etc.) (see FIG. 10 for example) for selectably interconnecting the sections to provide a continuous length when assembled, as seen in FIG. 11.

Figure 12:
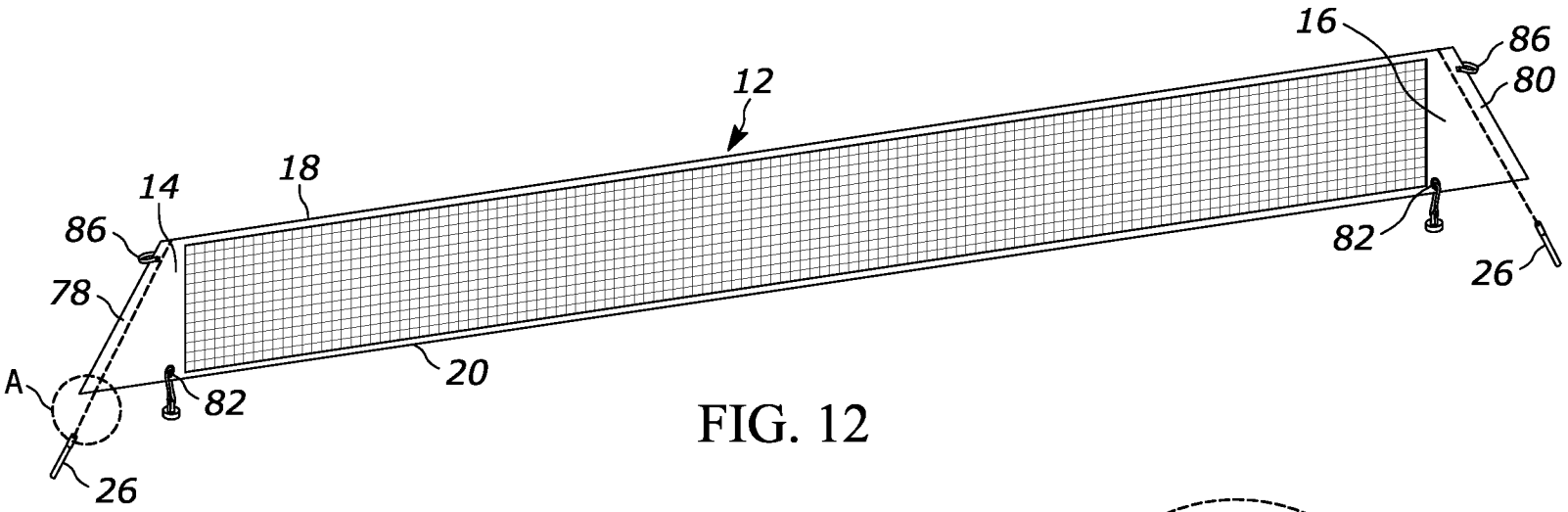
FIG. 12 is a perspective view of the net of the FIG. 1.
Figure 13:
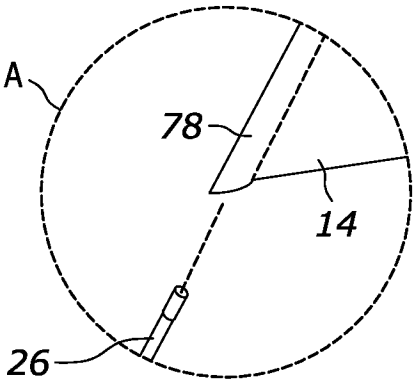
FIG. 13 is a close-up view taken from FIG. 12 at circle A.
Figure 14:
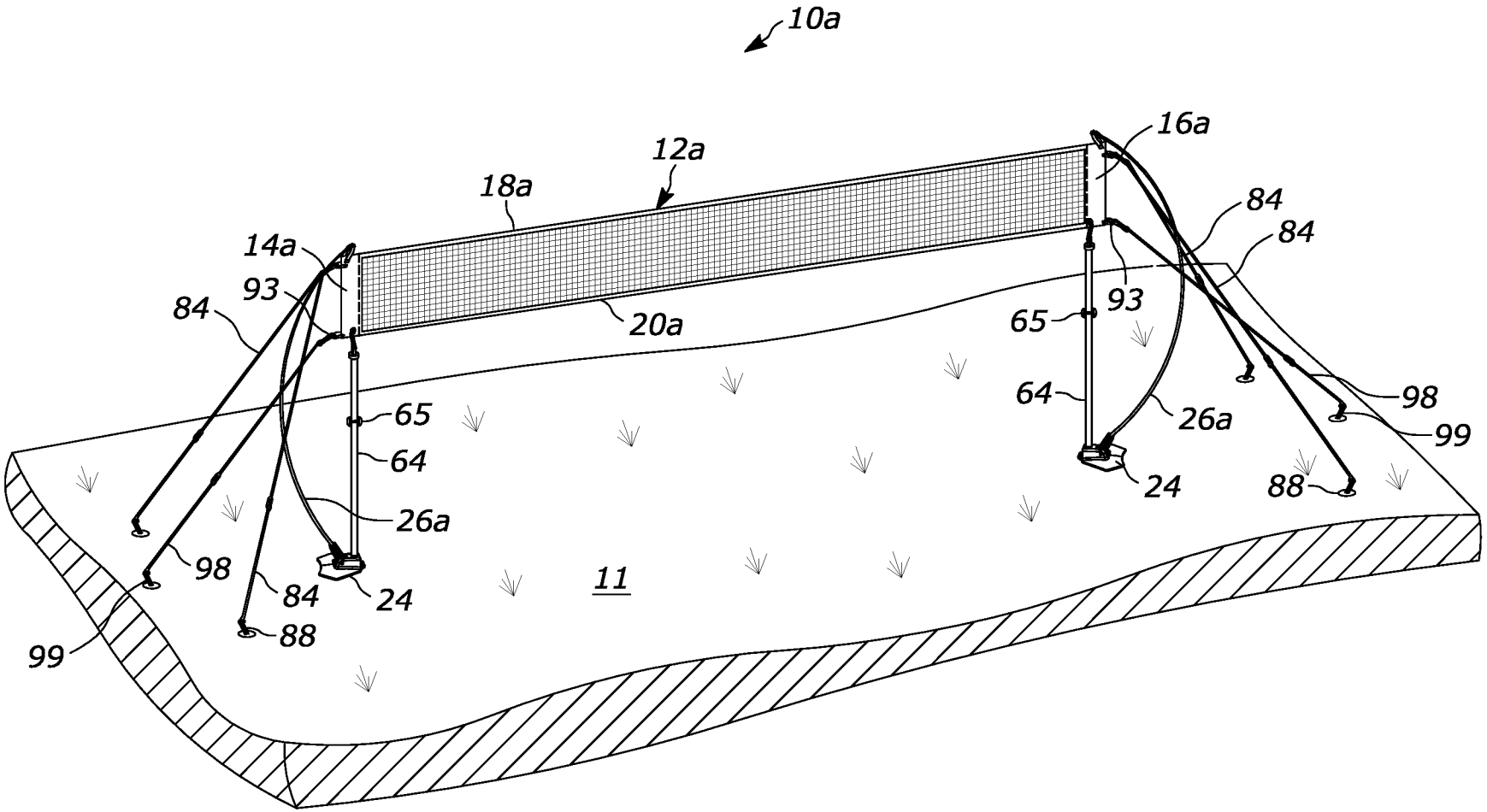
FIG. 14 is a perspective view of another exemplary embodiment of the flexible net system in a fully assembled position on a ground surface.
Figure 15:
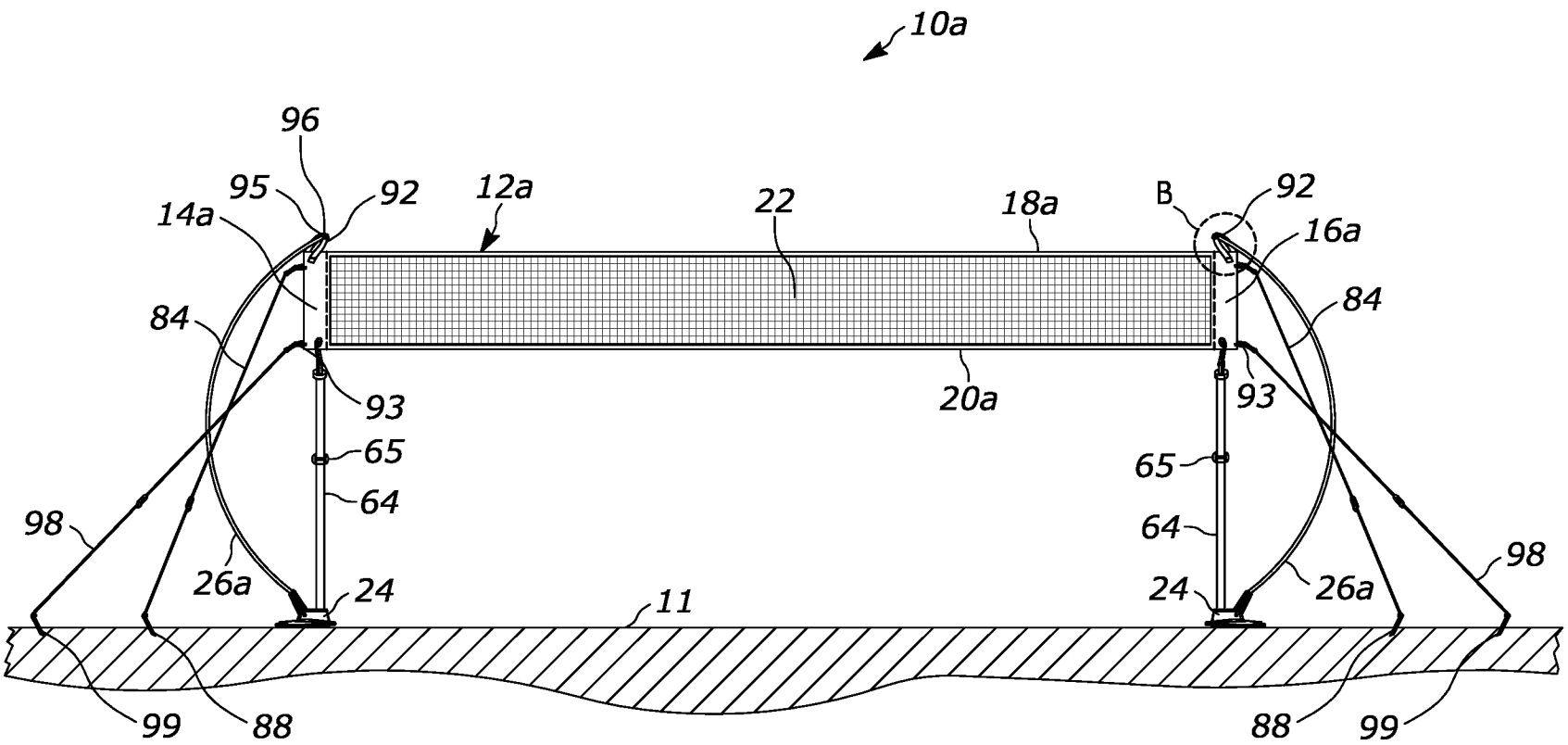
FIG. 15 is a front elevation view of the flexible net system of FIG. 14 in the fully assembled position on the ground surface.
Figure 16:
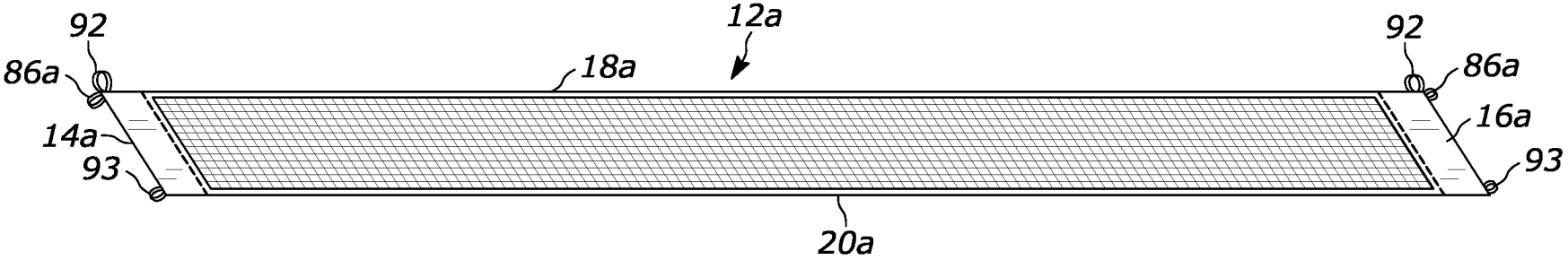
FIG. 16 is a perspective view of the net of the FIG. 14.

Referring to FIGS. 12 and 13, in at least some embodiments, the net 12 includes a first net sleeve 78 and a second net sleeve 80 positioned respectively at the net first end 14 and net second end 16, and wherein each net sleeve extends from the net top portion 18 towards the net bottom portion 20. The net sleeves 78, 80 are each sized and shaped to receive the net support poles 26 and are closed about the net top portion 18 to provide abutment of the net support poles 26. In at least some embodiments, the net sleeves 78, 80 are formed by overlapping and sewing the net 12 at the ends leaving a passage. FIG. 13 illustrates a close-up view of the first net sleeve 78 in position to receive the net support pole 26.

To assemble the flexible net system 10, support bases 24 (also referred to a first support base and a second support base) are positioned at either end of the net 12 and can be secured to the ground surface 11 using a ground stake. The net support poles 26 (also referred to as a first net support pole and a second net support pole) are each assembled (joined together longitudinally if sectioned) and then inserted respectively into the first and second net sleeves 78, 80 on each end of the net 12. Each net support pole 26 is then coupled to a support base 24 by insertion into the respective net support pole passage 60 of the support base 24. With the net 12 now positioned vertically the base straps 64 are to be connected. The user pulls the net down at the net first end 14, allowing on outward bending of the first net support pole (as the control arm 36 rotates from its vertical position under spring bias) and connects the base strap second end 72 to the net bottom portion 20. The net bottom portion 20 can include a grommet, loop, or ring 82 distanced from the first net sleeve 78 to which the base strap second end 72 is connected. In embodiments where the base straps 64 is adjustable in length, the base straps 64 can then be shortened or lengthened to move the net up or down against the bias of the net support poles 26 to achieve a desired net height relative to the ground surface 11. In such embodiments, the base straps 64 can include a moveable strap adjuster 65 (e.g., buckle, etc.) to vary the overlap of portions of the base strap 25 to modify the overall length, such strap adjusters are well known in the art for lengthening or shortening strap length.

To further stabilize the net 12, a plurality of primary support ropes 84 are coupled to the net top portion 18, wherein in at least some embodiments, the net top portion 18 includes a primary support tab 86 (e.g., grommet, loop, ring, etc.) at each of the net first end 14 and the net second end 16 to which the primary support ropes 84 can be coupled to. The plurality of primary support ropes 84 are then secured at their opposite ends adjacent the ground surface 11 with respective ground stakes 88 (generally in a V-shape to provide left-right stability).

Figure 17:
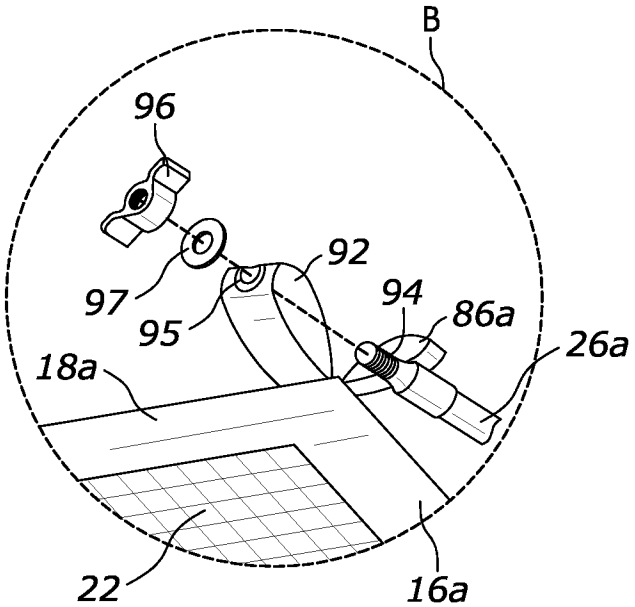
FIG. 17 is a partial close-up exploded view taken from FIG. 14 at circle B, showing an exemplary interconnection of the net support pole with the net.

The flexible net system 10 is versatile and allows for numerous variations to support a net. For example, another exemplary embodiment, flexible net system **10*a* illustrated in FIGS. 14-17, provides a net 12***a* that omits the net sleeves 78, 80 and instead uses upper pole loops 92 and secondary support tabs 93 (e.g., grommet, loop, ring, etc.) situated on each of the net first end 14*a* and net second end 16*a*, at the net top portion 18*a* and net bottom portion 20*a* respectively. Net support poles 26*a* are secured to the net top portion 18*a* using the upper pole loops 92 rather than fitted inside net sleeves. In at least some embodiments, as seen in FIG. 17 illustrating a exemplary close up exploded view of a portion of the flexible net system 10*a*, each net support pole 26*a* can include a threaded end portion 94 that is passed through an aperture 95 (grommet, etc.) in the upper pole loop 92 and then secured thereto with a securement nut 96 and washer 97, while in other embodiments, the net support poles 26*a* can be fastened to the net top portion 18*a* using other fastening means.

As the support bases 24 are unchanged for this embodiment, assembly of the flexible net system 10*a* is relatively similar to the assembly of the flexible net system 10, expect the net support poles 26*a* are fastened to the upper pole loops 92 rather than fitted inside net sleeves and a plurality of secondary support ropes, such as secondary support ropes 98 are provided that are secured respectively to the secondary support tabs 93 at the net bottom portion 20*a*. The secondary support ropes 98 are then secured at their opposite ends adjacent the ground surface with respective ground stakes 99 to further stabilize the net 12*a*.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of any appended claims and the description of the invention herein. It shall be understood that the phrase "a plurality" shall include one or more.

I claim:

1. A flexible net system comprising:

a net having a net first end and a net second end, with a net top portion and a net bottom portion extending between the net first end and the net second end;

a pair of support bases including a first support base and a second support base, each support base comprising:

a base bottom portion having a bottom surface for contact with a ground surface;

a support portion extending upwards from the base bottom portion, the support portion engaging and pivotably securing a control arm thereto, wherein the control arm is pivotable to a substantially vertical position; and a base strap having a base strap first end secured to the support portion and a base strap second end secured to the net bottom portion;

a first net support pole and a second net support pole, wherein the first net support pole and the second net support pole are resiliently bendable and coupled between the net and respective support bases; and a plurality primary support ropes coupled to the net and configured to be secured adjacent the ground surface with respective ground stakes.

2. The flexible net system of claim 1, wherein the first net support pole is coupled to the control arm of the first support base, and the second net support pole is coupled to the control arm of the second support base.

3. The flexible net system of claim 2, further including a plurality of springs coupled to the control arm and the support portion, wherein the plurality of springs biases the control arm away from the substantially vertical position.

4. The flexible net system of claim 3, wherein each net support pole includes two or more discrete sections longitudinally securable to each other.

5. The flexible net system of claim 3, wherein each control arm is limited to pivoting in a substantially single plane between about 0 and about 90 degrees.

6. The flexible net system of claim 5, wherein the first net support pole is coupled at the net top portion of the net first end, and the second net support pole is coupled at the net top portion of the net second end.

7. The flexible net system of claim 6, wherein each control arm includes a net support pole passage for receiving a portion of a respective net support pole therein.

8. The flexible net system of claim 7, wherein each of the support bases includes a staking aperture in the base bottom portion for receiving a respective ground stake at least partially therethrough.

9. The flexible net system of claim 7, wherein the base strap second end includes a latch for releasably coupling to the net bottom portion.

10. The flexible net system of claim 7, wherein the net further includes a first net sleeve and a second net sleeve positioned respectively at the net first end and net second end, and wherein each net sleeve extends from the net top portion towards the net bottom portion.

11. The flexible net system of claim 10, wherein the first net sleeve receives therein the first net support pole, and the second net sleeve receives therein the second net support pole.

12. The flexible net system of claim 3, wherein the net further includes a first net sleeve and a second net sleeve positioned respectively at the net first end and net second end, and wherein each net sleeve extends from the net top portion towards the net bottom portion and wherein the first net sleeve receives therein the first net support pole, and the second net sleeve receives therein the second net support pole.

13. The flexible net system of claim 12, wherein the base strap is adjustable in length.

14. The flexible net system of claim 13, wherein the first support base includes an arm channel for at least partially receiving the control arm therein.

15. The flexible net system of claim 7, wherein the first net support pole includes a first threaded end portion, and the second net support pole includes a second threaded end portion.

16. The flexible net system of claim 15, further comprising a first securement nut and a second securement nut, wherein the first threaded end portion is secured to the net top portion at the net first end with the first securement nut, and the second threaded end portion is secured to the upper net portion at the net second end with the second securement nut.

17. The flexible net system of claim 3, further comprising a first securement nut and a second securement nut, wherein the first net support pole includes a first threaded end portion, and the second net support pole includes a second threaded end portion, and wherein the first threaded end portion is secured to the upper net portion at the net first end with the first securement nut, and the second threaded end portion is secured to the upper net portion at the net second end with the second securement nut.

18. The flexible net system of claim 17, wherein the base strap is adjustable in length.

19. The flexible net system of claim 18, further comprising a secondary support rope coupled to the net bottom portion and configured to be secured adjacent the ground surface with a respective ground stake.

20. A flexible net system comprising:

a net having a net first end and a net second end, with a net top portion and a net bottom portion extending between the net first end and the net second end;

a pair of support bases including a first support base and a second support base, each support base comprising:

a base bottom portion having a bottom surface for contact with a ground surface;

a support portion extending upwards from the base bottom portion, the support portion including an arm channel for at least partially receiving and pivotably securing a control arm;

a plurality of springs coupled to the control arm and the support portion, wherein the plurality of springs provides a downward bias to the control arm; and an adjustable base strap having a base strap first end secured to the support portion and a base strap second end secured to the net bottom portion; and a first net support pole and a second net support pole, wherein the first net support pole and the second net support pole are resiliently bendable and coupled between the net and respective support bases, wherein the first net support pole is coupled to the control arm of the first support base, and the second net support pole is coupled to the control arm of the second support base.

* * * * *